US005927573A

United States Patent [19]

Votino et al.

[11] Patent Number: 5,927,573

[45] Date of Patent: Jul. 27, 1999

[54] SHOE HORN FOR THE PHYSICALLY HANDICAPPED

[76] Inventors: Anthony Votino; Louis Votino, both of 16439 GlenHope Dr., Valinda, Calif. 91744

[21] Appl. No.: 08/967,923

[22] Filed: Nov. 12, 1997

Related U.S. Application Data

[63] Continuation-in-part of application No. 08/713,131, Sep. 16, 1996, abandoned.

[51] Int. Cl.[6] ..... A47G 25/80; A47G 25/82

[52] U.S. Cl. ..... 223/111; 223/118; 223/119; 223/112

[58] Field of Search ..... 223/118, 119, 223/113, 116, 111, 112

[56] References Cited

U.S. PATENT DOCUMENTS

| | | | |
|---|---|---|---|
| 19,284 | 2/1858 | Allender | 223/119 |
| 594,894 | 12/1897 | Nylander | 223/118 |
| 4,709,839 | 12/1987 | Tucker | 223/119 |
| 4,966,316 | 10/1990 | George et al. | 223/118 |

FOREIGN PATENT DOCUMENTS

| | | | |
|---|---|---|---|
| 1729464 | 4/1992 | U.S.S.R. | 223/118 |

*Primary Examiner*—Bibhu Mohanty

*Attorney, Agent, or Firm*—John R. Ross; John R. Ross, III

[57] ABSTRACT

A shoe horn apparatus for helping a user insert a foot into a shoe. The shoe horn apparatus has a heel element matched to the heel of the user's foot and in addition the apparatus has a tongue part to hold the tongue of the shoe forward while the user inserts his foot. Portions of the shoe horn part and the tongue part are positioned to fit inside the shoe with the shoe horn being adjacent to the back edge of the shoe and the tongue part being adjacent to the lace part of the shoe, providing a space in between the shoe horn part and the tongue part for the user's foot to slip into the shoe guided by said shoe horn part and said tongue part. A support tab at the bottom of the handle in conjunction with the shoe horn and the tongue parts hold the shoe steady while it is being put on. The device permits the user to pretie his shoes. In a preferred embodiment a spring member permits a shoe to be held in spring compression between the support tab and the shoe horn and tongue parts. In a preferred embodiment a long handle is provided so that the user can hold the shoe horn apparatus in place while inserting his foot. In another preferred embodiment a sock donning aid is provided to make a kit for donning socks and shoes.

11 Claims, 6 Drawing Sheets

SHOE HORN FOR THE PHYSICALLY HANDICAPPED

This invention relates to shoe horns and in particular to shoe horns for people who can not reach their feet with their hands. This is a continuation-in-part application of Ser. No. 08/713,131 filed Sep. 16, 1996 now abandoned.

BACKGROUND OF THE INVENTION

Shoe horns have been available for very many years to help people insert their feet into shoes, especially tight shoes or shoes which have not been broken in. Typical shoe horns are about 3 or 4 inches long and about 1½ inches wide with the 1½ inches dimension having a curved shape to match the horizontal curvature of a persons heel. Typically a person using a prior art shoe horn will positioned the shoe horn inside the shoe at the back of the shoe and insert his foot into the shoe while holding the top edge of the shoe horn with one of his hands. The shoe horn helps guide the foot into the shoe. There are a very large number of people who for various reasons cannot reach their feet with either hand. Many people including many people with arthritic conditions can reach their feet but experience pain in doing so. These people typically get help putting on their shoes or wear slipper type shoes that they can merely slide their feet into without the need of using their hands. Some people are unable to tie their shoe laces or experience pain in doing so. Devices have been proposed to permit handicapped to put on their own shoes and socks. See, for example, U.S. Pat. No. 4,355,745 issued to Nelson which proposed a shoe horn with a long handle and U.S. Pat. No. 3,604,604 issued to Ahn to enable a handicapped person to put on his own socks.

An old but relevant invention was U.S. Pat. No. 19,284 issued to Allender which disclosed a device for holding shoes for the feet while the foot was inserted. The problem with Allender's device was that it had small intricate parts such as a thumb screw and a spring catch. These small parts could not be manipulated by a persons with certain serious hand handicaps: i.e., severe arthritis or amputated fingers. Allender and the other prior art shoe horn devices work well only if the shoe is loose or the laces are untied when the shoe is put on and the user is not handicapped.

What is needed is a better shoe horn apparatus that can be handled at a substantial distance from the feet and which will work with many types of shoes including pretied shoes with laces.

SUMMARY OF THE INVENTION

The present invention provides a shoe horn apparatus for helping a user insert a foot into a shoe. The shoe horn apparatus has a heel element matched to the heel of the user's foot and in addition the apparatus has a tongue part to hold the tongue of the shoe forward while the user inserts his foot. Portions of the shoe horn part and the tongue part are positioned to fit inside the shoe with the shoe horn being adjacent to the back edge of the shoe and the tongue part being adjacent to the lace part of the shoe, providing a space in between the shoe horn part and the tongue part for the user's foot to slip into the shoe guided by said shoe horn part and said tongue part. A support tab at the bottom of the handle in conjunction with the shoe horn and the tongue parts hold the shoe steady while it is being put on. The device permits the user to pretie his shoes. In a preferred embodiment a spring member permits a shoe to be held in spring compression between the support tab and the shoe horn and tongue parts. In a preferred embodiment a long handle is provided so that the user can hold the shoe horn apparatus in place while inserting his foot. In another preferred embodiment a sock donning aid is provided to make a kit for donning socks and shoes.

DETAILED DESCRIPTION OF PREFERRED EMBODIMENTS

Preferred embodiments of the present invention can be described by reference to the drawings. These drawings depict prototype models of embodiments of the present invention which Applicants have fabricated to demonstrate their invention. They have been used very successfully by one of the Applicants who is unable to reach his feet with his hands due to an arthritic condition and back and knee problems.

First Preferred Shoe Horn

Figures 1, 2, 3, 4:
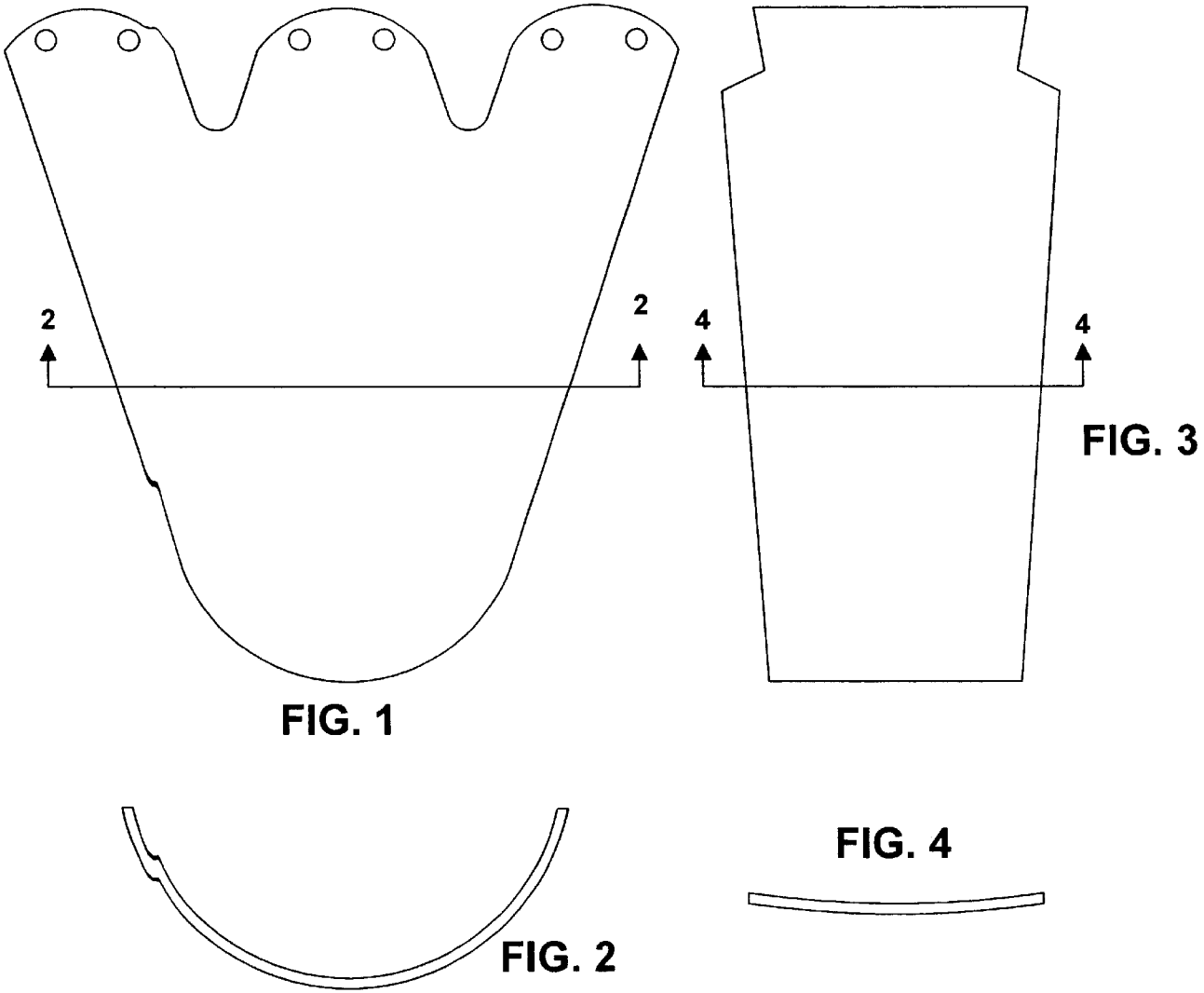
FIG. 1 is a drawing of a shoe horn part of a preferred embodiment of the present invention.
FIG. 2 is a cross section of the FIG. 1 part.
FIG. 3 is a drawing of the tongue part of a preferred embodiment of the present invention.
FIG. 4 is a cross section of the FIG. 3 part.
Figure 5:
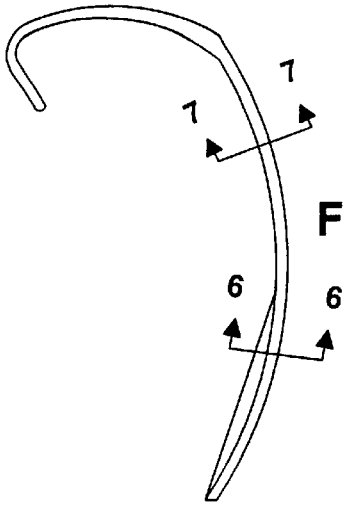
FIG. 5 is a drawing of the FIG. 3 part after being heat molded into a special shape.
Figure 7:
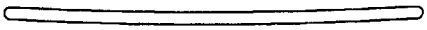
FIGS. 6 and 7 are cross sections of the FIG. 5 molded part.
Figure 6:
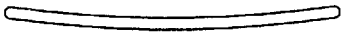

FIGS. 1 and 2 show two views of a a part of a preferred shoe horn. This part is cut from a polyethylene material having the shape of a plastic cup having a diameter of about 3½ inches at the top and 2¼ inches at the bottom. The shoe horn part is about 6½ inches high and retains the approximate shape of a molded plastic cup so that its horizontal radius curvature at the top is about 1¾ inches and its horizontal radius of curvature at the bottom is about 1⅛ inches. Six 1/16-inch diameter holes are drilled along the top edge as shown in FIG. 1. Note in FIG. 2 the shoe horn part has the general shape of the heel of a human foot.

FIGS. 3 through 7 show views of the tongue part 3 of this embodiment. It is also cut from the same polyethylene material. However, this part is heat molded first to the shape shown in FIGS. 3 and 4 and then into the shape shown in FIGS. 5, 6 and 7. Two 1/16-inch diameter holes are drilled at locations shown in FIG. 3.

In this embodiment a handle-frame is fabricated using PVC pipe and PVC pipe fittings. This handle-frame comprises a handle 2 which is a 32-inch piece of ½ inch pipe and a grip 4 made of a ½ inch tee and two pipe caps. A ½-inch cross 6 was reamed along one of its axes with a 13/16-inch drill so that handle 2 could slidingly pass through cross 6. Cross 6 is sometimes herein referred to as a slide member. A small screw 8 slides in a ⅛-inch by 1-inch slot 10 to limit the movement of handle 2 through cross 6. Pin 12 is used to position handle 2 within cross 6 by aligning pin 12 through one of 5⅛-inch diameter holes which are drilled in handle 2. These holes (not shown on the drawing) are at ½ inch intervals beginning 5½ inches from the bottom of handle 2.

A shoe horn part support 14 is made from three ½-inch 45 degree elbows and is connected to cross 6 with short pieces of ½-inch pipe. A tongue part support 16 is made from one 90 degree elbow and short pieces of ½ inch pipe.

Figure 8:
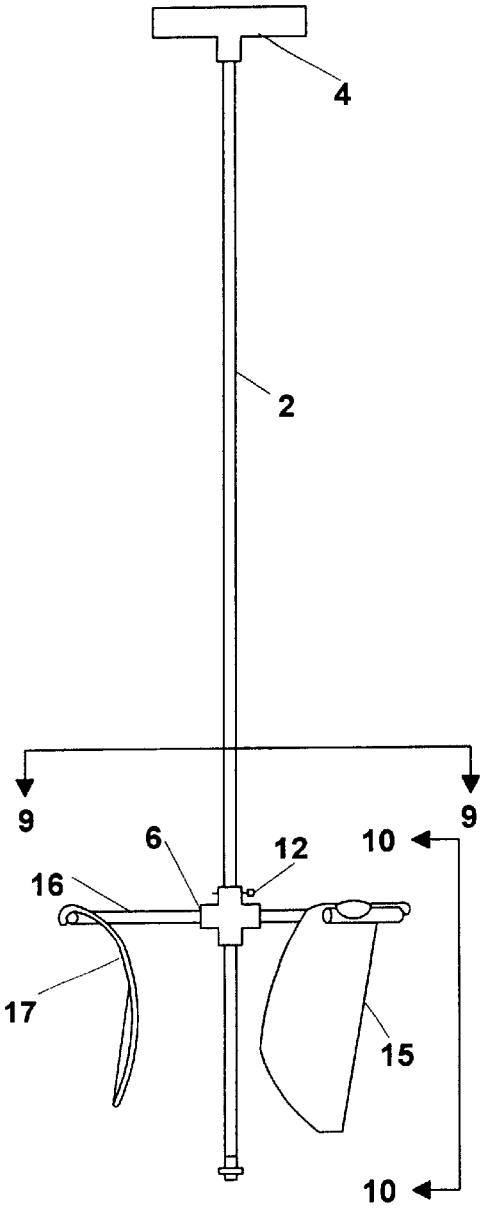
FIG. 8 is an assembly drawing of a preferred embodiment of the present invention.
Figure 9:
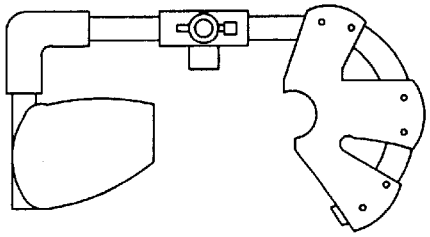
FIGS. 9 and 10 are views of the FIG. 8 assembly.
Figure 10:
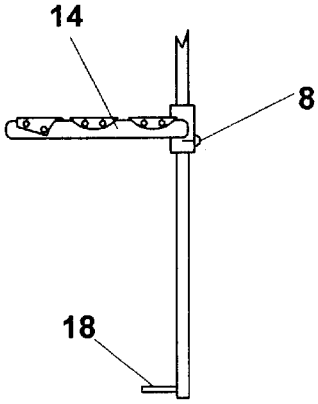

The shoe horn part 15 shown in FIGS. 1 and 2 is attached to the shoe horn part support with 6 small screws as shown is FIGS. 9 and 10. The tongue part 17 shown in FIGS. 3 through 7 is attached to tongue part support with two small screws as shown in FIG. 9. A tab at the top of tongue part 17 fits in a slot in tongue part support as shown in FIG. 8 to help hold the tongue part in place.

Support tab 18, which is a 1-inch long piece of plastic, is attached at the bottom of handle 2 as shown in FIGS. 8 and 10.

Use of Long Handle Shoe Horn Apparatus

Figure 11:
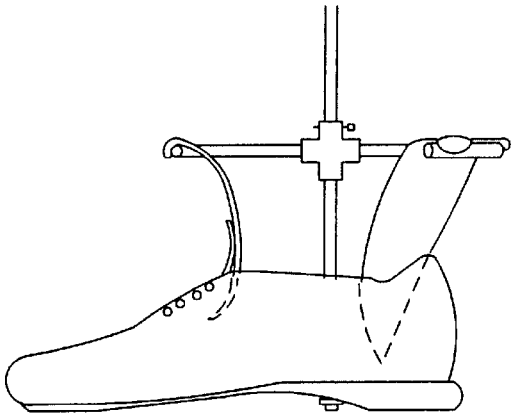
FIG. 11 is a drawing of the FIG. 8 assembly inserted in a shoe in preparation for a foot.
Figure 12:
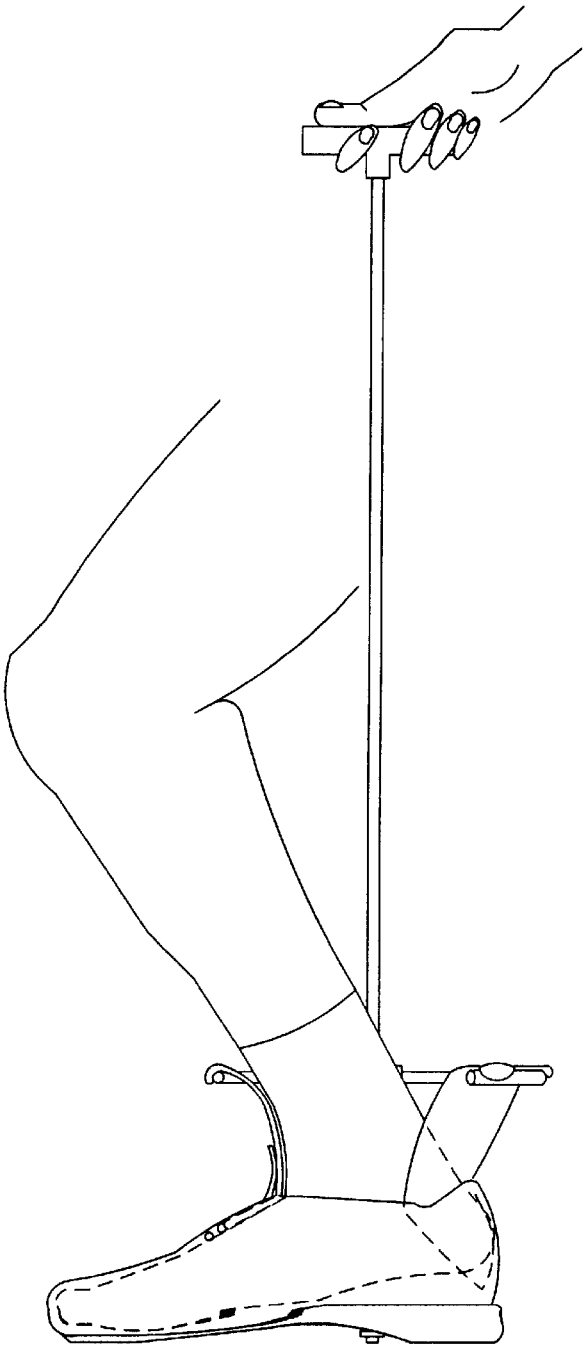
FIG. 12 is a drawing showing a foot being inserted into the FIG. 11 shoe using a the above preferred embodiment of the present invention.

FIG. 11 shows this preferred embodiment inserted in a shoe ready for a foot. The shoe horn part is snugly adjacent to the back edge of the shoe and the tongue part is adjacent to the lace part of the shoe. FIG. 12 shows a foot being inserted into the shoe using the preferred embodiment described above. Note that the user is holding the hand grip to steady the shoe horn part and the tongue parts in the shoe. Note also how support tab 18 fits under the shoe just in front of the heel to help steady the shoe while the foot is being inserted. This small piece of plastic is also used to hook or scrape a shoe across the floor so the user can reach it. The position of handle 2 in cross 6 is adjusted so that tab 18 fits snugly under the shoe sole just in front of the shoe heel when the bottom of shoe horn part 1 is touching the inside bottom of the shoe as shown in FIG. 11. The relative position of support tab 18 can be changed by repositioning cross 6 relative to handle 2 using pin 12. The adjustment accommodates the height of the shoe.

Figure 20:
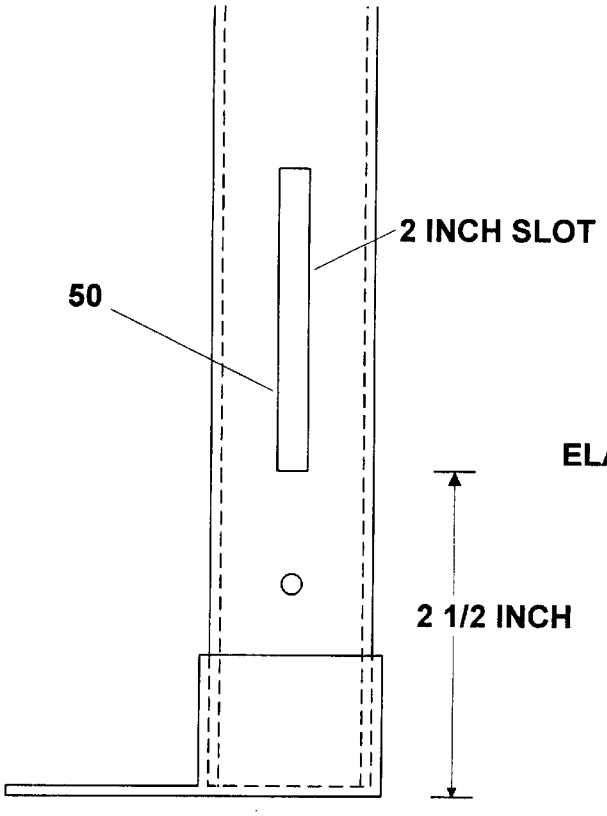
FIGS. 20 and 21 show a self adjusting embodiment of the present invention.
Figure 21:
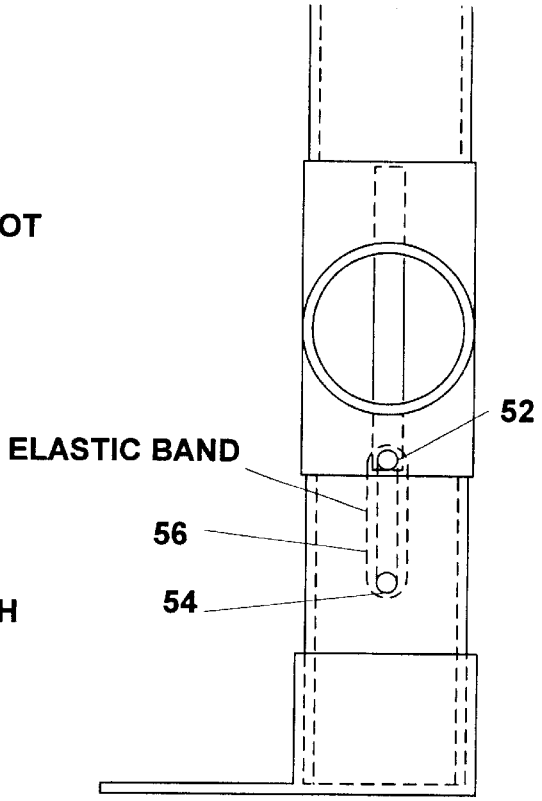

FIGS. 20 and 21 illustrate a better method of repositioning cross 6. As shown in FIG. 20, a two inch by ⅛ inch slot is cut in handle 2 beginning 2½ inches from the bottom of handle 2. A ⅙ inch diameter hole is drilled near the bottom of cross 6 and a 1/16 inch diameter hole is drilled in handle 2 at 1½ inch from the bottom of handle 2, as shown in FIG. 21. Two 1/16 inch diameter pins 52 and 54 are inserted through the two 1/16 inch diameter holes and are positioned inside a slightly stretched 1 inch diameter elastic band 56, also as shown in FIG. 21. This permits cross 6 to slide upward on handle 2 expanding elastic band 56. Therefore, when shoehorn part 15 and tongue part 17 are inserted in a shoe and support tab 18 is positioned under the sole of the shoe, the tension applied by elastic band 56 holds the shoe in place until the user's foot is inserted in it. With this embodiment, the shoe horn is self adjusting.

No Fingers Required

The present invention is a dramatic improvement over the prior art in that it was designed specifically with the handicapped in mind and consequently no fingers are required for its operation. Individuals with severe arthritis, broken fingers or even amputated fingers will now be able to don variety of shoe types, even including tightly tied tennis shoes and jogging shoes. There are no small parts that need adjusting with each use as in the prior art. So long as the user can grasp the hand grip between the palms of his hands (use of fingers are not required for this type of grip), he should be able to manipulate the shoe horn part and tongue part into the shoe and support tab 18 underneath the shoe. This would not have been possible utilizing prior art devices.

Sock Donning Device

Figure 15:
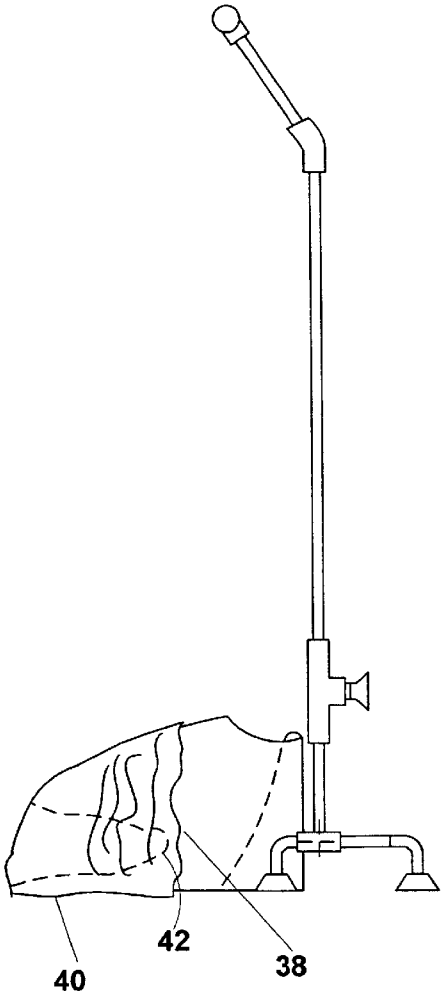
FIGS. 15 through 19 show the FIG. 13 device being used.
Figure 13:
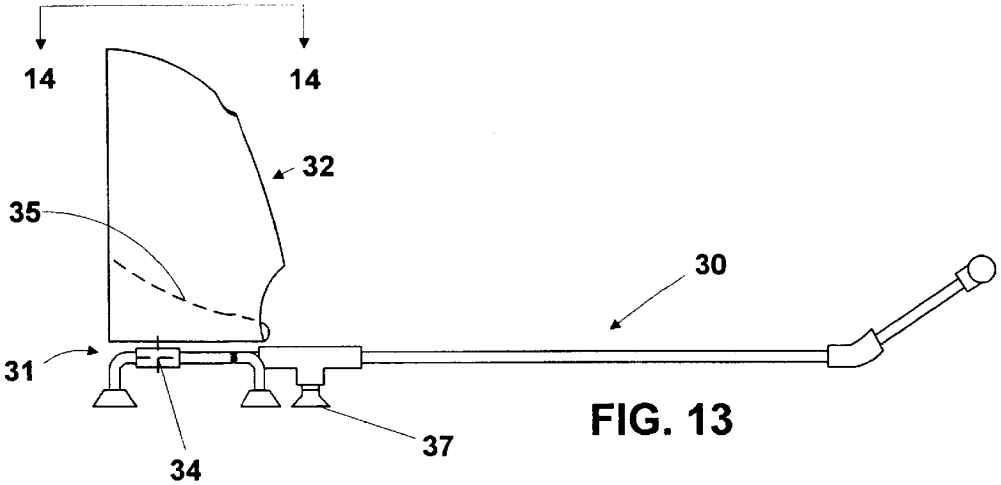
FIGS. 13 and 14 show two views of a device for donning socks.
Figure 14:
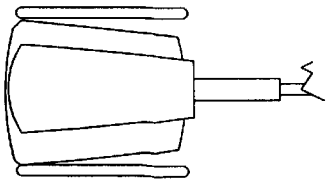
Figures 16, 17, 18, 19:
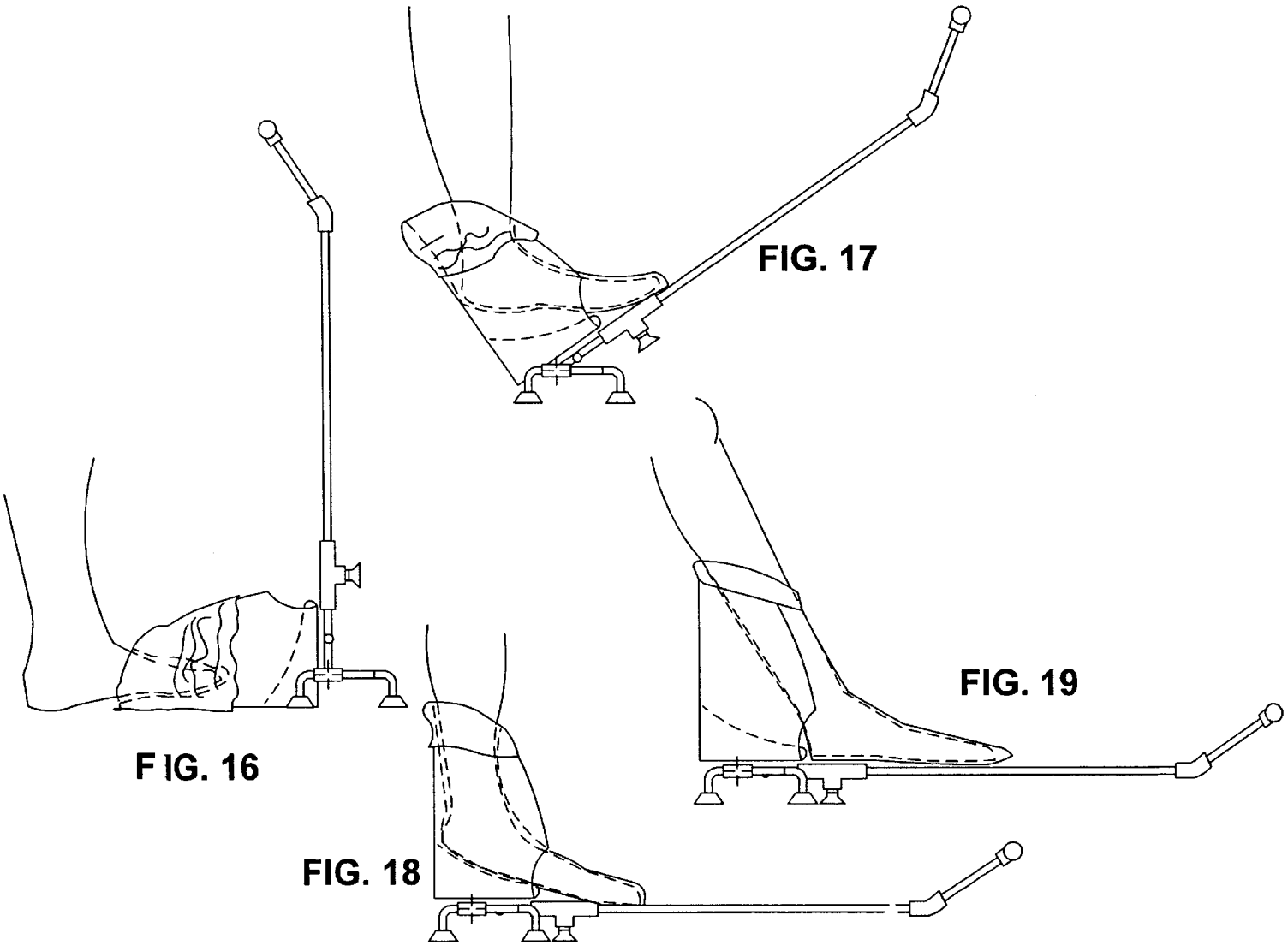

A preferred sock donning device is shown in FIGS. 13 and 14. Handle 30 and support 31 are made of PVC pipe and PVC pipe fittings and sock spreader 32 is cut and molded from polyethylene material having the general shape of the base of a jug. Sock spreader 32 retains the general shape of the base of a jug. Its base is roughly rectangular, about 3¾ inches by 5½ inches and the heel edge is about 9½ inches high. A bottom ramp 35 is comprised of a sheet of polyethylene about 3¼ inches by 6 inches. Handle 30 and sock spreader 31 pivot about and an axial in support 31, the centerline of which is shown at 34 in FIG. 13. As shown in FIG. 15, handle 30 is tilted up and a sock 36 is spread over sock spreader 32. The top edge of the sock is positioned at 38, the heel at 40 and the toe at 42, all as shown in FIG. 15. A foot is inserted as shown in FIG. 16. The foot is moved forward as shown in FIG. 17 causing sock spreader 32 and handle 30 to rotate. As the foot reaches the bottom of sock spreader 32, handle 30 is horizontal and the sock covers the foot and the lower part of the leg. The user then slides his foot forward out of sock spreader 32 as shown in FIG. 19 until the sock and leg is free of sock spreader 32 and the sock is installed. This embodiment comprises a mushroom shaped metal desk drawer knob 37 about one inch in diameter which is used by the user to remove shoes and socks.

While the above description contains many specificities, the reader should not construe these as limitations on the scope of the invention, but merely as exemplifications of preferred embodiments thereof. Those skilled in the art will envision many other possible variations that are within its scope. For example, flexible steel could replace the plastic heel part and the plastic tongue part. The handle and the support parts could also be steel or other metals. Many different types of plastics could be used. The elastic band could be replaced by other spring members such as metal springs. Although the Applicant's prototype device was fabricated using existing plastic parts and materials, commercial embodiments will preferably be mass produced using plastics molding and extrusion techniques well known in the plastics art. Accordingly, the reader is requested to determine the scope of the invention by the appended claims and their legal equivalents and not by the examples which have been given.

We claim:

1. A long handle shoe horn apparatus for helping a user insert a foot into a shoe defining a lace part, a heel, a sole and an inside bottom and a back edge, said apparatus comprising:

A) a handle at least two feet long defining a grip location and a handle bottom, B) a slide member movably mounted on said handle at a position at least two feet from said grip location, C) a shoe horn support mounted on said slide member C) a tongue part support mounted on said slide member D) a shoe horn part mounted on said shoe horn support, E) a tongue part having a generally tongue shape and comprised of flexible material mounted on said tongue part support, and F) a support tab located at the bottom of said handle and positioned relative to said shoe horn part to fit beneath said shoe sole just in front of said heel when the bottom of the shoe horn part is touching the inside bottom of the shoe;

portions of said shoe horn part and said tongue part being positioned to fit inside the shoe with the shoe horn being adjacent to the back edge of the shoe and the tongue part being adjacent to the lace part of the shoe, providing a space in between the shoe horn part and the tongue part for the user's foot to slip into the shoe guided by said shoe horn part and said tongue part.

2. A long handle shoe horn apparatus as in claim 1 wherein said shoe horn part and said tongue part are comprised of polyethylene plastic.

3. A long handle shoe horn apparatus as in claim 1 wherein said shoe horn part and said tongue part are comprised of acrylic plastic.

4. A long handle shoe horn apparatus as in claim 1 wherein said shoe horn part and said tongue part are comprised of polyvinyl chloride plastic.

5. A long handle shoe horn apparatus as in claim 1, further comprising a spring means to apply a compressive force on said shoe between said support tab and said shoe horn and said tongue parts.

6. A long handle shoe horn apparatus as in claim 1 wherein:

A) said handle comprises a slot,

B) said slide member is slidingly positioned on said handle over at least a portion of said slot, and further comprising:

1) a first attachment means attached to said slide member and passing through said slot, 2) a second attachment means fixed on said handle near the bottom of said handle, and 3) a spring member attached to said first attachment means and said second attachment means to apply a spring force when said slide member is slid toward said a handle.

7. Along handle shoe horn apparatus as in claim 6 wherein said spring member comprises an elastic band.

8. A sock and shoe donning kit comprising:

A) a long handle shoe horn apparatus for helping a user insert a foot into a shoe defining a lace part and a back edge, said apparatus comprising:

1) a handle at least two feet long defining a grip location, 2) a shoe horn support mounted on said handle at a position at least two feet from said grip location, 3) a tongue part support mounted on said handle at a position at least two feet from said grip location, 4) a shoe horn part mounted on said shoe horn support, and 5) a tongue part having a generally tongue shape and comprised of flexible material mounted on said tongue part support;

portions of said shoe horn part and said tongue part being positioned to fit inside the shoe with the shoe horn being adjacent to the back edge of the shoe and the tongue part being adjacent to the lace part of the shoe, providing a space in between the shoe horn part and the tongue part for the user's foot to slip into the shoe guided by said shoe horn part and said tongue part;

B) a sock donning device comprising:

a sock spreader in the form of a frame with a rearward wall and two side walls and no forward wall, said walls being spaced so that a sock can be spread over the rearward wall and the two side walls with the toe of the sock suspended in between the walls.

9. A kit as in claim 8 wherein said sock donning device also comprises a support supporting said sock spreader.

10. A kit as in claim 9 wherein said sock spreader is pivotally supported on said support at an axle.

11. A kit as in claim 10 where in said sock donning device also comprises a handle attached to said sock spreader and pivots with said sock spreader on said axle.

* * * * *